US010267338B2

(12) United States Patent
Takeshita et al.

(10) Patent No.: US 10,267,338 B2
(45) Date of Patent: Apr. 23, 2019

(54) IMPELLER AND MOTOR

(71) Applicant: Nidec Corporation, Kyoto (JP)

(72) Inventors: Hidenobu Takeshita, Kyoto (JP); Yasuyuki Kaji, Kyoto (JP); Guiling Zhang, Kyoto (JP)

(73) Assignee: Nidec Corporation, Kyoto (JP)

( * ) Notice: Subject to any disclaimer, the term of this patent is extended or adjusted under 35 U.S.C. 154(b) by 122 days.

(21) Appl. No.: 15/658,455

(22) Filed: Jul. 25, 2017

(65) Prior Publication Data

US 2018/0031003 A1 Feb. 1, 2018

(30) Foreign Application Priority Data

Jul. 27, 2016 (JP) ..... 2016-147648

(51) Int. Cl.

| | |
|---|---|
| ***F04D 29/66*** | (2006.01) |
| ***F04D 25/06*** | (2006.01) |
| ***F04D 29/38*** | (2006.01) |
| ***F04D 19/00*** | (2006.01) |
| ***F04D 29/32*** | (2006.01) |
| ***F04D 29/68*** | (2006.01) |

(52) U.S. Cl.

CPC ..... *F04D 29/666* (2013.01); *F04D 19/002* (2013.01); *F04D 25/06* (2013.01); *F04D 29/329* (2013.01); *F04D 29/384* (2013.01); *F04D 29/681* (2013.01)

(58) Field of Classification Search

CPC .... F04D 29/666; F04D 29/681; F04D 29/329; F04D 25/06; F04D 29/384; F04D 19/002

See application file for complete search history.

(56) References Cited

U.S. PATENT DOCUMENTS

| | | | | |
|---|---|---|---|---|
| 8,235,672 | B2 * | 8/2012 | Choi | F04D 29/384 416/234 |
| 2002/0085912 | A1 * | 7/2002 | Blass | F04D 29/329 415/208.2 |
| 2015/0204342 | A1 | 7/2015 | Liang et al. | |

FOREIGN PATENT DOCUMENTS

| | | | | |
|---|---|---|---|---|
| JP | 08-49697 | A | 2/1996 | |
| JP | 2012-87713 | A | 5/2012 | |
| WO | WO-2013060358 | A1 * | 5/2013 | F04D 25/082 |

* cited by examiner

*Primary Examiner* — Hung Q Nguyen
(74) *Attorney, Agent, or Firm* — Keating & Bennett, LLP

(57) ABSTRACT

An impeller includes a hub rotated about an up-down axis and inclined blades disposed circumferentially on a hub's outer circumferential surface. The outer circumferential surface includes a first surface including a portion axially overlapping the blade above its joined portion to the blade, a second surface including a portion axially overlapping the blade below the joined portion, and a connecting portion connecting a rotating-direction rear end of the first outer circumferential surface and a rotating-direction front end of the second outer circumferential surface. The connecting portion is arranged forward of a rotating-direction blade front edge. A distance from the axis to a first point, positioned at the rotating-direction rear end of the first outer circumferential surface, is not shorter than that from the axis to a second point, positioned at the rotating-direction front end of the second outer circumferential surface and at the same axial position as the first point.

10 Claims, 16 Drawing Sheets

IMPELLER AND MOTOR

CROSS REFERENCE TO RELATED APPLICATIONS

This application claims the benefit of priority to Japanese Patent Application No. 2016-147648 filed on Jul. 27, 2016. The entire contents of this application are hereby incorporated herein by reference.

1. Field of the Invention

The present invention relates to an impeller for generating airflow, and a motor including the impeller.

2. Description of the Related Art

JP-A No. 2012-87713 discloses a blower impeller using a truncated conical hub with intent to increase static pressure. The disclosed blower impeller includes the truncated conical hub and a plurality of vanes formed around the hub and radially extending from the hub.

In the hub of the blower impeller, a vane root portion has an outer diameter gradually increasing from the intake side toward the outlet side. Therefore, it is difficult to form the blower impeller only with a mold that is drawn in an axial direction. To avoid such a difficulty, a method of molding the hub and the vanes as separate parts, and attaching the vanes to the hub is also disclosed. With the disclosed method, however, man-hours increase and the manufacturing cost rises. Furthermore, the strength of attached portions between the hub and the vanes may reduce depending on the attaching method. In addition, there is a risk that variations in weights of the plurality of attached portions along a circumferential direction may cause vibration, noise, etc.

SUMMARY OF THE INVENTION

According to an exemplary embodiment of the present invention, there is provided an impeller including a hub having an outer circumferential surface, the hub being rotated about a center axis extending in an up-down direction, and a plurality of inclined blades that are disposed on the outer circumferential surface of the hub at intervals in the circumferential direction, the inclined blades being inclined relative to the center axis and arranged such that a front edge of each of the inclined blades in a rotating direction is positioned on an upper side than a rear edge thereof. The outer circumferential surface of the hub includes a first outer circumferential surface including a portion arranged at a position overlapping the inclined blade in a direction of the center axis, the position being present above a joined portion of the outer circumferential surface to the inclined blade, a second outer circumferential surface including a portion arranged at a position overlapping the inclined blade in the direction of the center axis, the position being present rearward of the first outer circumferential surface in the rotating direction and below the joined portion of the outer circumferential surface to the inclined blade, and a connecting portion that connects an end of the first outer circumferential surface on a rear side in the rotating direction and an end of the second outer circumferential surface on a front side in the rotating direction to each other. The connecting portion is arranged forward of the front edge of the inclined blade in the rotating direction, and the first outer circumferential surface is a curved surface having a curvature radius that gradually increases downward from above. A tangential plane at an arbitrary point on the second outer circumferential surface is positioned parallel to the center axis or farther away from the center axis on an upper side than on a lower side, and a distance from the center axis to an arbitrary first point, which is positioned at the end of the first outer circumferential surface on the rear side in the rotating direction, is equal to or longer than a distance from the center axis to a second point, which is positioned at the end of the second outer circumferential surface on the front side in the rotating direction and at a same position as the first point in the direction of the center axis.

With the impeller according to the exemplary embodiment of the present invention, high static pressure can be obtained, and manufacturing of the impeller can be simplified.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
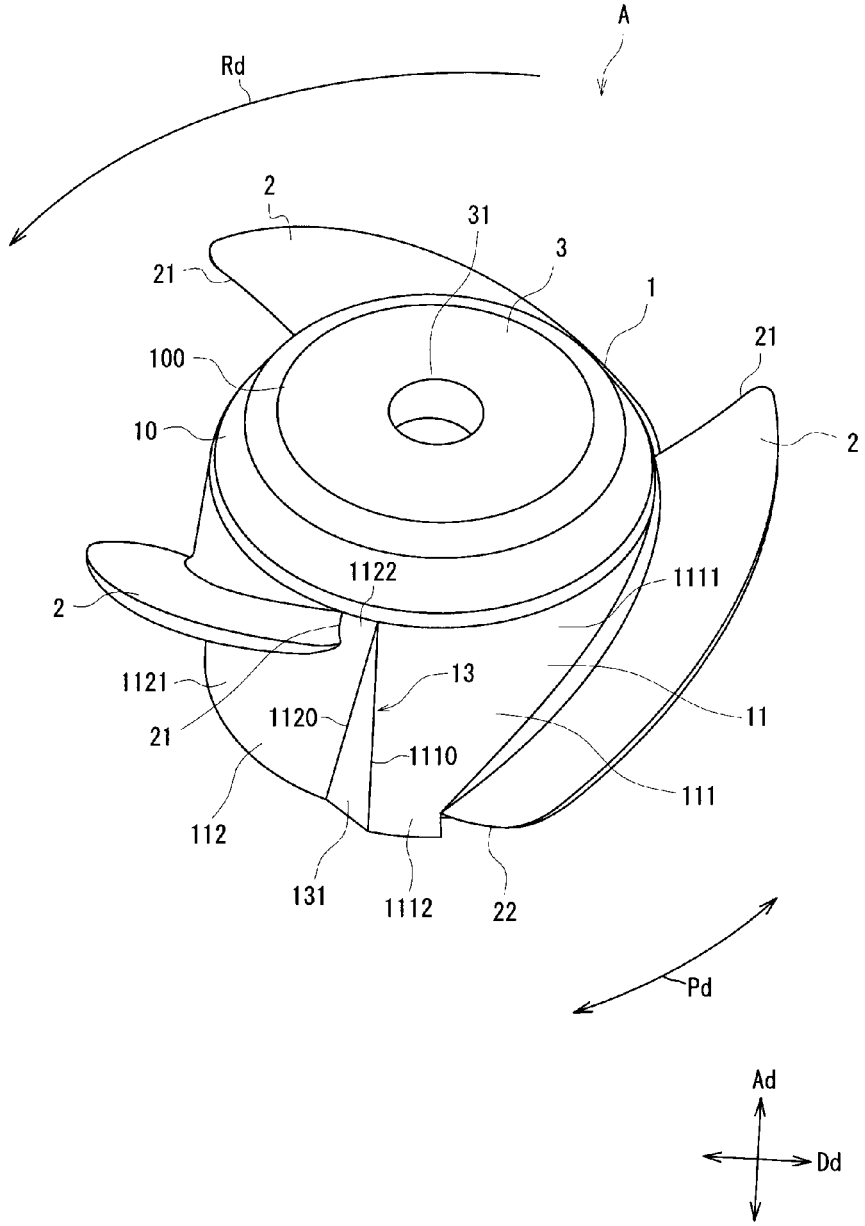
FIG. 1 is a perspective view of an example of an impeller according to the present invention.

An exemplary first embodiment of the present invention will be described below with reference to the drawings. In the following description, a direction in which a center axis extends is defined as an "axial direction". A direction perpendicular to the center axis is defined as a "radial direction" with the center axis being a center. A direction extending along a circular arc with the center axis being a center is defined as a "circumferential direction". Furthermore, the axial direction is defined as an "up-down direction" on the basis of a state illustrated in FIG. 1. In the case of indicating a position in the up-down direction, the positional relation is denoted using "above", "upper side", "below", and "lower side" in some cases. Those words are defined as follows. The word "above" stands for a relation that one member is positioned above the other member at a position overlapping the other member in the axial direction. The word "upper side" stands for a relation that one member is positioned above the other member regardless of whether both the members are overlapped with each other. Similarly, the word "below" stands for a relation that one member is positioned below the other member at a position overlapping the other member in the axial direction. The word "lower side" stands for a relation that one member is positioned below the other member regardless of whether both the members are overlapped with each other. Additionally, the axial direction is denoted by Ad, the radial direction is denoted by Dd, and the circumferential direction is denoted by Pd. Those signs are indicated in the drawings together with arrows as required.

Figure 2:
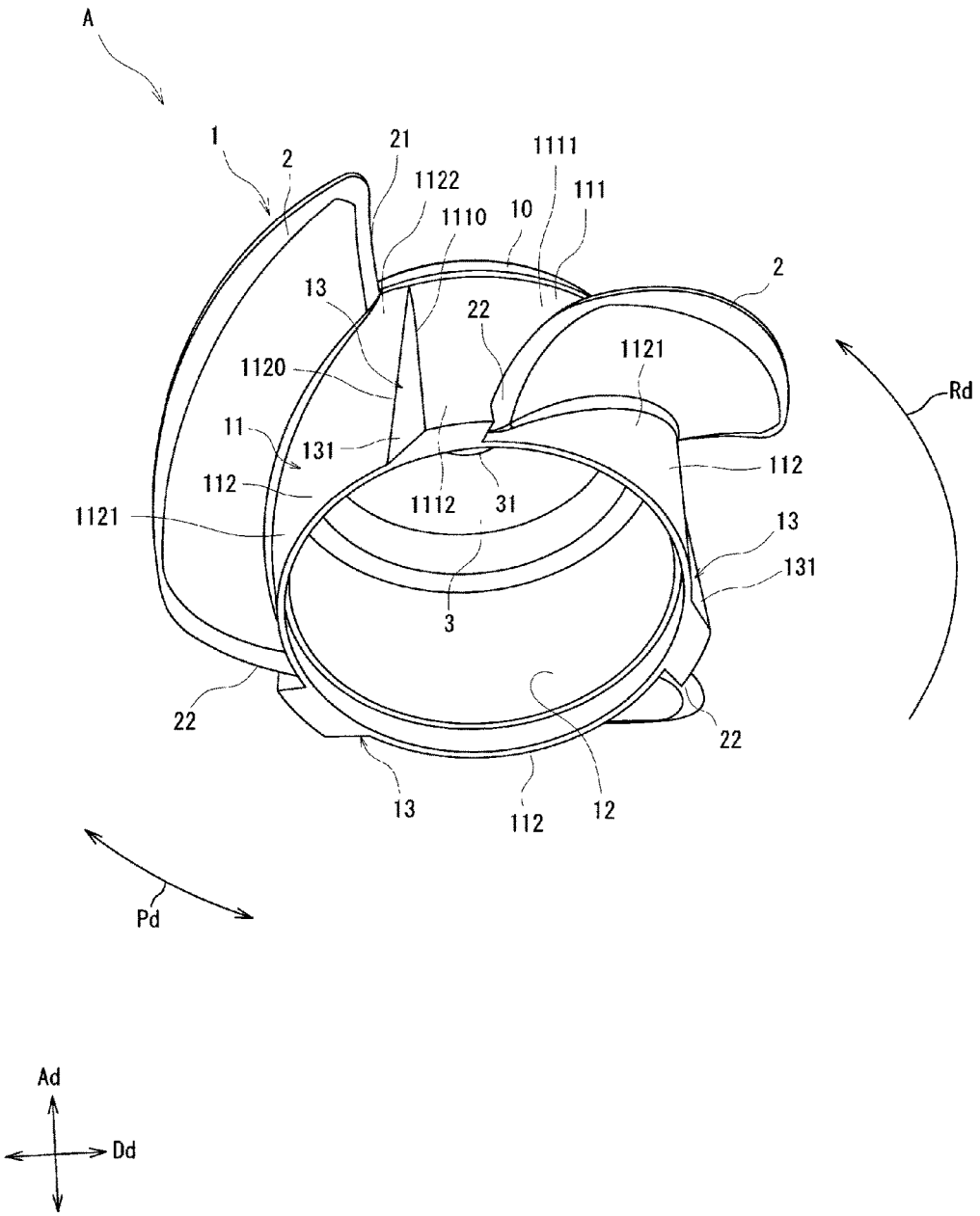
FIG. 2 is a perspective view when looking at the impeller, illustrated in FIG. 1, from an opposite side in an axial direction.
Figure 3:
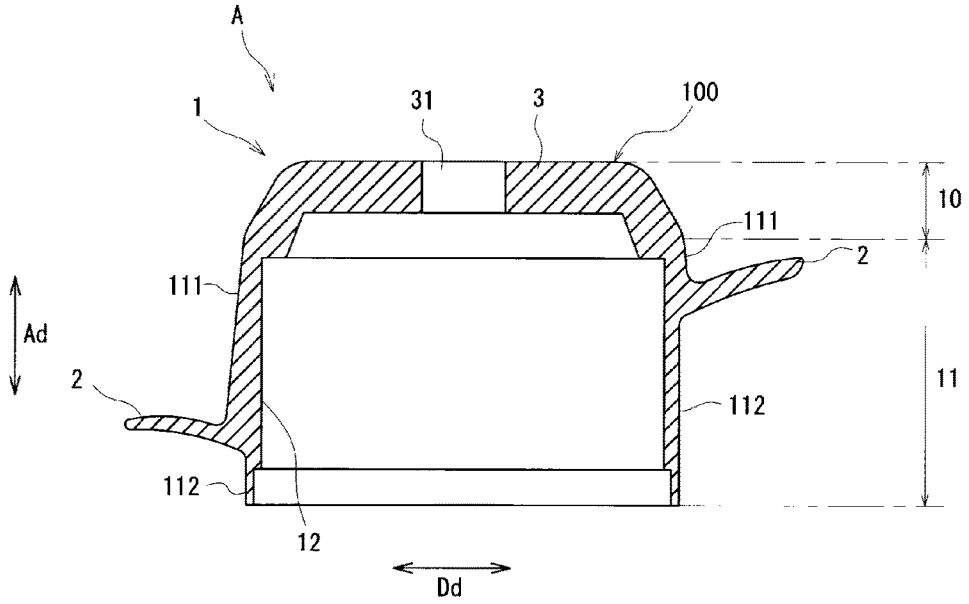
FIG. 3 is a sectional view when cutting the impeller, illustrated in FIG. 1, along a plane extending along a center axis.
Figure 4:
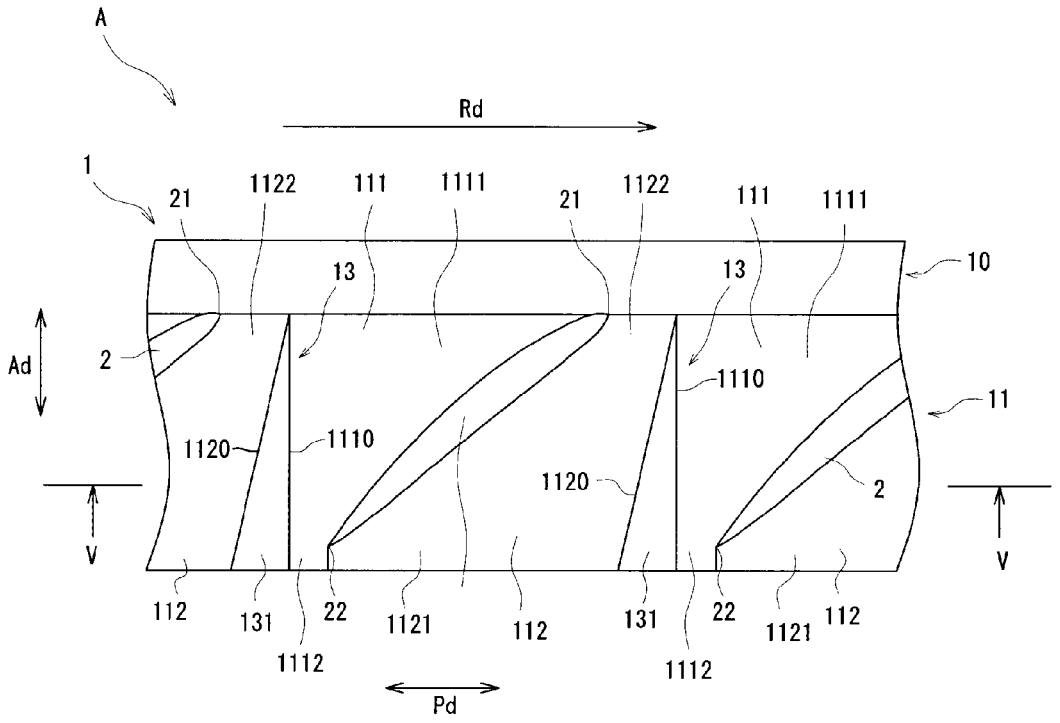
FIG. 4 is a development view when developing the impeller, illustrated in FIG. 1, in a circumferential direction.
Figure 5:
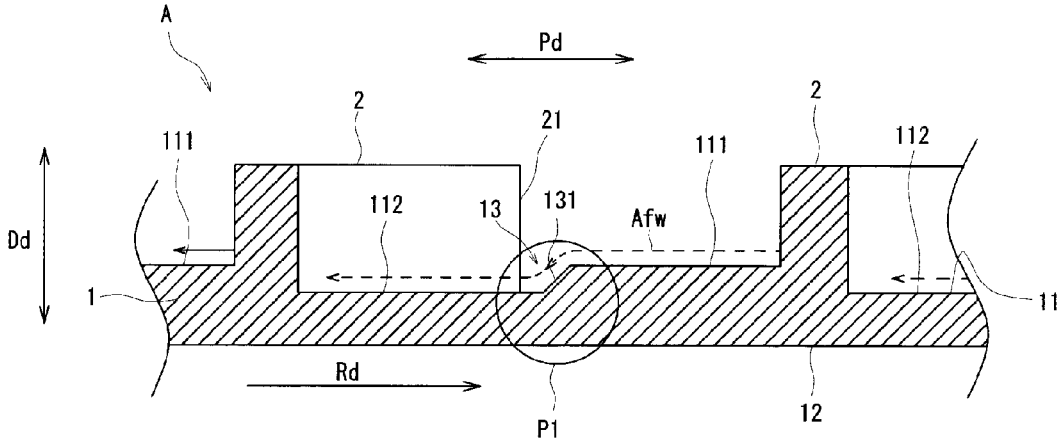
FIG. 5 is a sectional view when cutting the impeller, illustrated in FIG. 4, along a line V-V.
Figure 6:
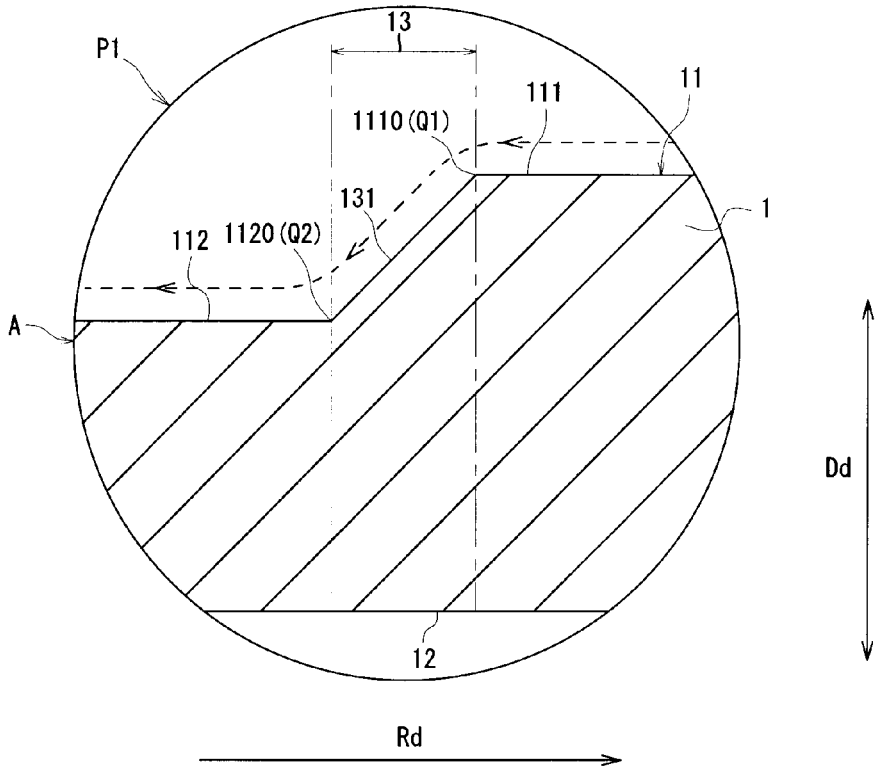
FIG. 6 is an enlarged view illustrating, in an enlarged scale, a connecting portion of a hub illustrated in FIG. 5.

Shapes of individual members and positional relations among the individual members will be described below by employing the above-defined directions. The definition of the up-down direction is made for convenience of explanation, and it is not intended to restrict the orientation and the position of an impeller in use. FIG. 1 is a perspective view of an example of an impeller according to the present invention. FIG. 2 is a perspective view when looking at the impeller, illustrated in FIG. 1, from an opposite side in the axial direction. FIG. 3 is a sectional view when cutting the impeller, illustrated in FIG. 1, along a plane extending along a center axis. FIG. 4 is a development view when developing the impeller, illustrated in FIG. 1, in a circumferential direction. FIG. 5 is a sectional view when cutting the impeller, illustrated in FIG. 4, along a line V-V. FIG. 6 is an enlarged view illustrating, in an enlarged scale, a connecting portion of a hub illustrated in FIG. 5. It is to be noted that, in FIGS. 5 and 6, a circumferential surface, i.e., an outer circumferential surface 11 of a hub 1, is developed over a flat plane. In FIG. 6, a region surrounded by a circle P1 in FIG. 5 is illustrated in an enlarged scale.

In this embodiment, an impeller A rotates in a certain direction. As illustrated in FIG. 1, a rotating direction of the impeller A is counterclockwise when viewed in the axial direction from above. In the following description, the rotating direction of the impeller A is denoted by Rd. The rotating direction Rd is indicated together with an arrow in the drawing where the rotating direction is denotable.

The impeller A includes the hub 1, three inclined blades 2, and a boss portion 3. More specifically, the impeller A includes the hub 1 having the outer circumferential surface 11 and rotated about a center axis extending in the up-down direction, and a plurality of the inclined blades 2 that are disposed on the outer circumferential surface 11 of the hub 1 at intervals in the circumferential direction.

The inclined blades 2 are arranged on the outer circumferential surface 11 of the hub 1, and they extend outward in the radial direction. The three inclined blades 2 are arranged at equal intervals in the circumferential direction. However, the present invention is not limited to the illustrated example. In another example, the number of inclined blades 2 may be two, or four or more. As an alternative, only one inclined blade 2 may be used. In the case of arranging the plurality of inclined blades 2, the intervals between the adjacent inclined blades 2 may be different from each other. The boss portion 3 is in the form of a circular plate extending inward in the radial direction from an upper end 100 of the hub 1 in the axial direction. Though described in detail later, the hub 1, the inclined blades 2, and the boss portion 3 are formed as one member. One example of a method of forming the hub 1, the inclined blades 2, and the boss portion 3 as one member is injection molding that includes steps of pouring a material into a mold, and removing the mold after the completion of molding.

The inclined blades 2 extend outward in the radial direction from the outer circumferential surface 11 of the hub 1. As illustrated in FIG. 4, the inclined blades 2 are each inclined relative to the axial direction. Each of the inclined blades 2 is in the form of, for example, a plate having a spiral surface. It is here assumed that the term "spiral surface" implies not only a spiral surface in a strict sense, but also a wide variety of curved surfaces extending in the circumferential direction while shifting in the axial direction.

In the inclined blade 2, a front edge 21, i.e., a forward end in the rotating direction, is arranged on the upper side in the axial direction than a rear edge 22, i.e., a rearward end in the rotating direction. In other words, the inclined blade 2 is arranged in such a state that it is inclined relative to a center axis, and that the front edge 21 in the rotating direction is arranged on the upper side than the rear edge 22. The front edge 21 is arranged at an upper end of a later-described first outer circumferential surface 111 of the outer circumferential surface 11 in the axial direction. The rear edge 22 is arranged near a lower end of a later-described second outer circumferential surface 112 of the outer circumferential surface 11 in the axial direction. Preferably, the rear edge 22 of the inclined blade 2 is arranged as close as possible to the lower end of the second outer circumferential surface 112 in the axial direction. More preferably, the rear edge 22 reaches the lower end of the second outer circumferential surface 112 in the axial direction. With the rear edge 22 reaching the lower end of the second outer circumferential surface 112 in the axial direction, a level difference between a rear-side region of the second outer circumferential surface 112 in the rotating direction and the first outer circumferential surface 111 can be eliminated, and the occurrence of turbulence, vibration, etc. can be suppressed.

The boss portion 3 has a circular ring shape extending inward in the radial direction from the upper end 100 of the hub 1 in the axial direction. The boss portion 3 has a boss hole 31 that is formed at a center in the radial direction for fixation to a rotation shaft of a prime mover such as a motor. The boss hole 31 is a through-hole penetrating the boss portion 3 in the axial direction.

As described above, the hub 1 has a cylindrical shape extending in the axial direction. The hub 1 includes a tapered surface 10, the outer circumferential surface 11, and an inner circumferential surface 12. Part of the motor for rotating the impeller A is placed inside the hub 1. A cylindrical magnet used for the motor is fixed to the inner circumferential surface 12. Details of the motor will be described later.

The tapered surface 10 is arranged above the outer circumferential surface 11 in the axial direction, and it has a role of promoting inflow of air toward the impeller A. The curvature radius of the tapered surface 10 gradually increases downward from the upper side in the axial direction. Thus, the tapered surface 10 has a truncated conical shape with the center axis being a center. Although the tapered surface 10 has the role of promoting the inflow of air, it may be omitted when not required.

The tapered surface 10 and the first outer circumferential surface 111 are continuously joined to each other in the axial direction in a differentiable fashion. In other words, a joining portion between the tapered surface 10 and the first outer circumferential surface 111 has a smooth surface. When the impeller A is rotated, air flows toward the first outer circumferential surface 111 from the tapered surface 10. Since the tapered surface 10 and the first outer circumferential surface 111 are joined to each other in a smooth form, turbulence in flow of air can be suppressed.

The turbulence in flow of air changes depending on properties (such as temperature and humidity), flow velocity, etc. of air. When the turbulence in flow of air is hard to occur, irregularities may be formed in the joining portion between the tapered surface 10 and the first outer circumferential surface 111 to such an extent as not causing the turbulence of air. Alternatively, irregularities may be formed in the joining portion to provide a feature of controlling the flow of air.

The inclined blade 2 is joined to the outer circumferential surface 11. The outer circumferential surface 11 has the first outer circumferential surface 111, the second outer circumferential surface 112, and a connecting portion 13. The first outer circumferential surface 111 has a first portion 1111 and a second portion 1112. The first portion 1111 is arranged to be overlapped with the inclined blade 2 in the axial direction and to be positioned above, in the axial direction, a portion where the inclined blade 2 is joined to the outer circumferential surface 11. The second portion 1112 is formed in continuity with the rear side of the first portion 1111 in the rotating direction and is arranged on the rear side of the rear edge 22 of the inclined blade in the rotating direction. In other words, the first outer circumferential surface 111 includes the first portion 1111 that is overlapped with the inclined blade 2 in the axial direction, and that is positioned above the joined portion of the inclined blade 2 to the outer circumferential surface 11 in the axial direction.

As illustrated in FIGS. 1 and 2, the first outer circumferential surface 111 is a circumferential surface with the center axis being a center. The wording "circumferential surface with the center axis being a center" implies a surface having a shape in which the center of a curvature at an arbitrary point is aligned with the center axis. Examples of the circumferential surface include surfaces of a circular cylinder, a truncated cone, a cut sphere, a combined shape of those examples, and a part of the combined shape. While a section resulting from cutting the above-described shape along a plane perpendicular to the center axis has a circular or circular-arc shape, the section may be a curved surface having one of other suitable shapes, such as an elliptic shape, than a circular shape.

Furthermore, as illustrated in FIG. 3, the curvature radius of the first outer circumferential surface 111 gradually increases downward from the upper side in the axial direction. In other words, the first outer circumferential surface 111 has a shape (so-called tapered shape) in which a lower portion in the axial direction is fatter than an upper portion. Thus, since the curvature radius of the first outer circumferential surface 111 gradually increases downward from the upper side in the axial direction, i.e., toward the outlet side from the intake side, static pressure generated by the impeller A is increased.

The second outer circumferential surface 112 has a first portion 1121 and a second portion 1122. The first portion 1121 is arranged to be overlapped with the inclined blade 2 in the axial direction and to be positioned below, in the axial direction, the portion where the inclined blade 2 is joined to the outer circumferential surface 11. The second portion 1122 is formed in continuity with the front side of the first portion 1121 in the rotating direction and is arranged on the front side of the front edge 21 of the inclined blade 2 in the rotating direction. In other words, the second outer circumferential surface 112 includes the first portion 1121 that is overlapped with the inclined blade 2 in the axial direction, and that is positioned below the joined portion of the inclined blade 2 to the outer circumferential surface 11 in the axial direction.

In the hub 1 described in this embodiment, the second outer circumferential surface 112 is a circumferential surface with the center axis being a center. A cut end of the second outer circumferential surface 112 resulting from cutting the hub 1 along a section perpendicular to the center axis has a constant curvature radius in any section, i.e., regardless of a position of the section in the axial direction. Thus, the second outer circumferential surface 112 has a uniform curvature radius over its entirety from the upper side toward the lower side in the axial direction. In other words, as illustrated in FIG. 3, in the hub 1 in this embodiment, a cut end of the second outer circumferential surface 112 resulting from cutting the hub 1 along a plane including the center axis and extending along the center axis is parallel to the center axis. Accordingly, a tangential plane at an arbitrary point in the second outer circumferential surface 112 is parallel to the center axis. Sizes of the first outer circumferential surface 111 and the second outer circumferential surface 112 will be described later.

An end 1110 of the first outer circumferential surface 111 on the rear side in the rotating direction and an end 1120 of the second outer circumferential surface 112 on the front side in the rotating direction are connected to each other with a connecting portion 13 interposed therebetween. In other words, the outer circumferential surface 11 of the hub 1 includes the connecting portion 13 that interconnects the end 1110 of the first outer circumferential surface 111 on the rear side in the rotating direction and the end 1120 of the second outer circumferential surface 112 on the front side in the rotating direction. Furthermore, the connecting portion 13 is arranged on the front side of at least the front edge 21 of the inclined blade 2 in the rotating direction. In the following description, the end 1110 of the first outer circumferential surface 111 on the rear side in the rotating direction is simply called the end 1110 of the first outer circumferential surface 111, and the end 1120 of the second outer circumferential surface 112 on the front side in the rotating direction is simply called the end 1120 of the second outer circumferential surface 112 in some cases.

In the hub 1, as described above, the curvature radius of the first outer circumferential surface 111 gradually increases downward from the upper side in the axial direction. On the other hand, the curvature radius of the second outer circumferential surface 112 is uniform over its entirety from the upper side toward the lower side in the axial direction. As illustrated in FIGS. 5 and 6, the end 1110 of the first outer circumferential surface 111 is positioned on the outer side in the radial direction of the hub 1 relative to the end 1120 of the second outer circumferential surface 112.

When cutting the impeller A along a line V-V, for example, a distance from the center axis to a first point Q1 (see FIG. 6), which is positioned at the end 1110 of the first outer circumferential surface 111 on the rear side in the rotating direction, is longer than a distance from the center axis to a second point Q2, (see FIG. 6), which is positioned at the end 1120 of the second outer circumferential surface 112 on the front side in the rotating direction. Also when cutting the impeller A along a line other than the line V-V, the first point at the end 1110 of the first outer circumferential surface 111 and the second point at the end 1120 of the second outer circumferential surface 112 have the same feature. Thus, a distance from the center axis to an arbitrary first point, which is positioned at the end 1110 of the first outer circumferential surface 111 on the rear side in the rotating direction, is equal to or longer than a distance from the center axis to a second point, which is positioned at the end 1120 of the second outer circumferential surface 112 on the front side in the rotating direction and at the same position as the first point in the axial direction. In other words, at the same position in the axial direction, the distance from the center axis to the end 1110 of the first outer circumferential surface 111 (i.e., the curvature radius thereof at the end 1110) is equal to or longer than the distance from the center axis to the end 1120 of the second outer circumferential surface 112 (i.e., the curvature radius thereof at the end 1120).

The connecting portion 13 includes an inclined surface 131 that is connected to each of the end 1110 of the first outer circumferential surface 111 on the rear side in the rotating direction and the end 1120 of the second outer circumferential surface 112 on the front side in the rotating direction. As described above, the curvature radius of the first outer circumferential surface 111 gradually increases downward from the upper side in the axial direction. On the other hand, the curvature radius of the second outer circumferential surface 112 is uniform over its entirety from the upper side toward the lower side in the axial direction. Therefore, a distance from the center axis to the inclined surface 131 gradually decreases from the end 1110 (Q1) of the first outer circumferential surface 111 toward the end 1120 (Q2) of the second outer circumferential surface 112. Stated in another way, in the inclined surface 131, the distance from the center axis, i.e., the distance in the radial direction, gradually decreases in a direction (i.e., a flow direction of airflow Afw) that is opposite to the rotating direction of the hub 1. Thus, the connecting portion 13 has the inclined surface 131 positioned at a distance in the radial direction, the distance gradually decreasing from the first outer circumferential surface 111 toward the second outer circumferential surface 112. It is to be noted that the first outer circumferential surface 111 and the second outer circumferential surface 112 are connected to each other with the inclined surface 131 interposed therebetween to provide a continuous surface.

The connecting portion 13 is arranged on the front side of the front edge 21 of the inclined blade 2 in the rotating direction. In the hub 1 described in this embodiment, as seen from FIG. 4, a gap area where the inclined blade 2 is not arranged is present in the outer circumferential surface 11 between the inclined blades 2 adjacent to each other in the circumferential direction. In the hub 1, the connecting portion 13 is arranged in the gap area. Thus, the connecting portion 13 is positioned between the rear edge 22 of the inclined blade 2, which is arranged on the front side in the rotating direction of the hub 1, and the front edge 21 of the inclined blade 2, which is arranged on the rear side in the rotating direction of the hub 1.

The impeller A rotates about the center axis in the rotating direction Rd. Flow of air relative to the outer circumferential surface 11 of the hub 1 is described here. In FIGS. 5 and 6, relative airflow Afw, i.e., flow of air relative to the outer circumferential surface 11, is denoted by a dotted-line arrow.

When the impeller A rotates in the rotating direction, a surface of the inclined blade 2 on the front side in the rotating direction pushes air, thereby generating flow of air (airflow). The airflow Afw flows relative to the outer circumferential surface 11 in a direction opposite to the rotating direction. In other words, with the rotation of the impeller A in the rotating direction Rd, the airflow Afw is generated in the direction relatively opposite to the rotating direction Rd near the outer circumferential surface 11 (see FIGS. 5 and 6). Thus, the airflow Afw flows from the first outer circumferential surface 111 to the second outer circumferential surface 112 along the outer circumference of the hub 1.

In the connecting portion 13, a position of the end 1110 of the first outer circumferential surface 111 in the radial direction, the end 1110 being located on the upstream side in the flow direction of the airflow Afw, is higher than a position of the end 1120 of the second outer circumferential surface 112 in the radial direction, the end 1120 being located on the downstream side. In other words, the inclined surface 131 of the connecting portion 13 is recessed inward in the radial direction while extending toward the downstream side in the flow direction of the airflow Afw. Therefore, when the airflow Afw flows from the first outer circumferential surface 111 to the second outer circumferential surface 112, the airflow Afw flows along the connecting portion 13 and the inclined surface 131 causes less resistance against the airflow Afw. Thus, since the airflow Afw is less susceptible to turbulence, it is possible to suppress the turbulence of the airflow Afw and the occurrence of a stagnation point. As a result, vibration, noise, etc. can be suppressed during the rotation of the impeller A.

In the impeller A, as described above, the hub 1, the inclined blades 2, and the boss portion 3 are formed as one member. In the case of molding the impeller A with resin, for example, the impeller A is often formed by injection molding that includes steps of injecting (pouring) a molten resin into an assembled shaping mold (metal mold), and removing the mold after solidification of the resin.

In the injection molding, the cost can be reduced by employing a smaller number of molds. In the impeller A according to this embodiment, separate molds are at least used to mold portions above the inclined blades 2 in the axial direction and portions below the inclined blades 2 in the axial direction in order that the hub 1 and the inclined blades 2 are molded as one member. The molds are pulled and removed after solidification of a molded product. In the following description, the step of removing the molds is called "drawing of the molds". For example, the mold arranged above the inclined blades 2 in the axial direction during the molding is removed upward in the axial direction, namely drawn upward in the axial direction, after the molding. The molds used in the case of molding various portions of the impeller A with the injection molding will be described below.

The inclined blades 2 are each in the form of a plate having a helical surface. Thus, the inclined blade 2 has a three-dimensional curved surface. In trying to mold the inclined blades 2 with the injection molding, therefore, the inclined blade 2 can be molded using a mold that is to be drawn upward in the axial direction, and a mold that is to be drawn downward in the axial direction.

The hub 1 includes the tapered surface 10, the outer circumferential surface 11, and the inner circumference surface 12. An upper portion of the tapered surface 10 in the axial direction has an outer diameter smaller than that of a lower portion thereof. Accordingly, the tapered surface 10 can be molded using the mold that is to be drawn upward in the axial direction. The inner circumference surface 12 has, as illustrated in FIG. 3, a shape obtained by connecting two circular cylinders having different inner diameters to each other in the axial direction. Of the two circular cylinders defining the inner circumference surface 12, the inner diameter of the lower circular cylinder in the axial direction is larger than that of the upper circular cylinder in the axial direction. Accordingly, the inner circumference surface 12 can be molded using the mold that is to be drawn downward in the axial direction.

The first outer circumferential surface 111 includes the first portion 1111 that is arranged above the inclined blade 2 in the axial direction. Furthermore, the curvature radius of the first outer circumferential surface 111 is smaller in its upper portion in the axial direction than in its lower portion. Accordingly, the first outer circumferential surface 111 can be molded using the mold that is to be drawn upward in the axial direction.

The second outer circumferential surface 112 includes the first portion 1121 that is arranged below the inclined blade 2 in the axial direction. Furthermore, the curvature radius of the second outer circumferential surface 112 is uniform over its entirety from the upper side toward the lower side in the axial direction. In other words, the first portion 1121 of the second outer circumferential surface 112 has a cylindrical shape having an outer diameter that is not changed over its entirety from the upper side toward the lower side in the axial direction. Accordingly, the second outer circumferential surface 112 can be molded using the mold that is to be drawn upward in the axial direction.

Moreover, as illustrated in FIG. 4, the end 1110 of the first outer circumferential surface 111, which is joined to the inclined surface 131, extends in the axial direction when viewed from the radial direction. On the other hand, the end 1120 of the second outer circumferential surface 112, which is joined to the inclined surface 131, extends such that an upper portion of the end 1120 in the axial direction inclines forward in the rotating direction relative to a lower portion thereof. Thus, the inclined surface 131 is a surface inclined to face upward in the axial direction. Accordingly, the connecting portion 13 can be molded, similarly to the first outer circumferential surface 111, using the mold that is to be drawn upward in the axial direction. Although a part of the second portion 1122 of the second outer circumferential surface 112 is arranged above the inclined surface 131 in the axial direction, that part can be molded using the mold that is to be drawn upward in the axial direction, because the curvature radius of the second outer circumferential surface 112 is uniform over its entirety from the upper side toward the lower side in the axial direction.

The boss portion 3 is in the form of a circular ring. The boss hole 31, which is a through-hole, extends in the axial direction and has a uniform inner diameter in the axial direction. Accordingly, the boss portion 3 can be molded using the mold that is to be drawn upward in the axial direction, and the mold that is to be drawn downward in the axial direction.

As described above, according to the impeller A, static pressure can be increased by designing a part of the outer circumferential surface 11 of the hub 1, the part including the first portion 1111 positioned above the inclined blade 2 in the axial direction, i.e., the first outer circumferential surface 111, in the shape flaring in the radial direction while extending from the upper side toward the lower side in the axial direction. Furthermore, the impeller A can be formed using the mold that is to be drawn upward in the axial direction, and the mold that is to be drawn downward in the axial direction. Stated in another way, a mold to be drawn in the radial direction is no longer required. Therefore, the configuration of the molds can be simplified. Moreover, since the direction of drawing the molds after the injection molding is only the axial direction, a manufacturing apparatus can also be simplified. Thus, the impeller A according to this embodiment is able to increase static pressure, and to reduce the manufacturing cost.

Regarding the mold to be drawn downward, the mold for shaping the inner circumference surface 12 and the mold for shaping the first portion 1121 of the second outer circumferential surface 112 of the outer circumferential surface 11 may be separate molds. In such a case, because the mold for shaping the inner circumference surface 12, the mold for shaping the outer circumferential surface 11, and the mold for shaping the first portion 1121 of the second outer circumferential surface 112 are separate from one another, the number of molds increases, but configurations of the individual molds can be simplified.

Figure 7:
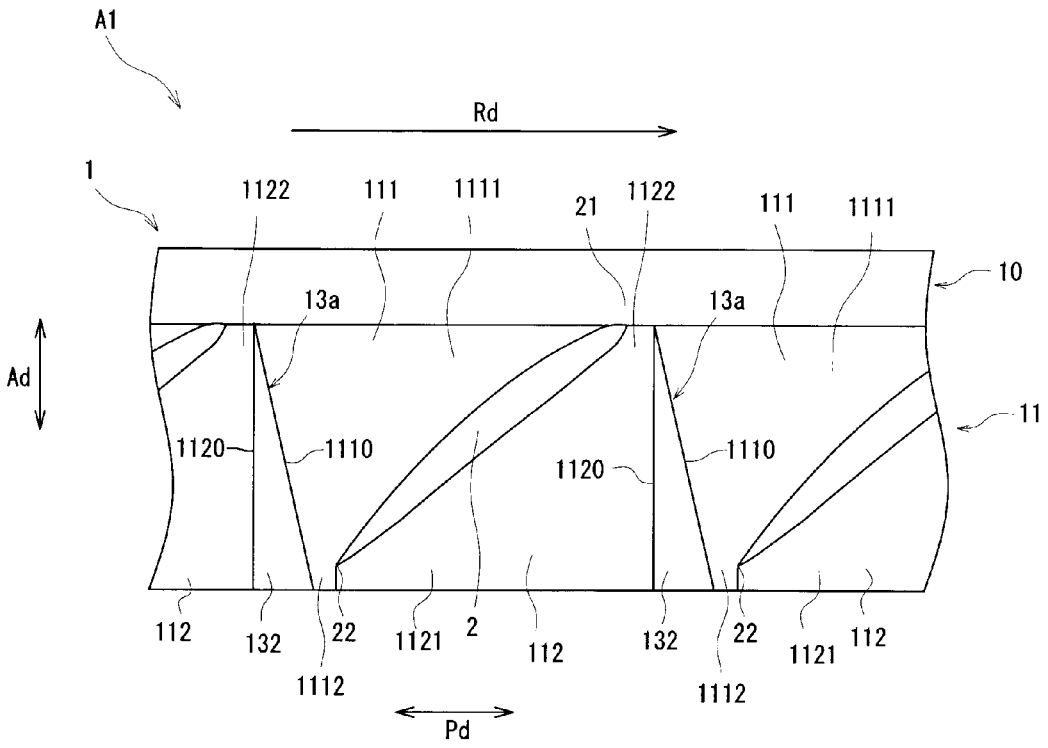
FIG. 7 is a development view of a modification of the impeller according to the first embodiment.
Figure 8:
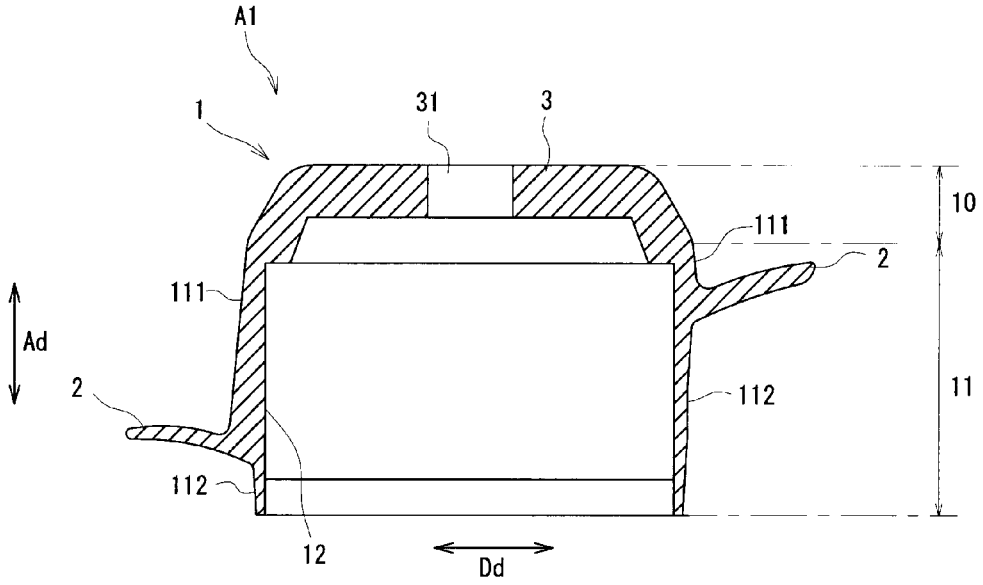
FIG. 8 is a sectional view when cutting the impeller, illustrated in FIG. 7, along a center axis.

A modification of the hub 1 in the first embodiment will be described below with reference to the drawings. FIG. 7 is a development view of a modification of the impeller according to the first embodiment. FIG. 8 is a sectional view when cutting the impeller, illustrated in FIG. 7, along a center axis. An impeller Al according to this modification has the same structure as the impeller A except for an inclined surface 132 of a connecting portion 13*a*. Accordingly, substantially the same components are denoted by the same reference signs.

In the impeller A1, as illustrated in FIG. 7, when viewed from the radial direction, the end 1120 of the second outer circumferential surface 112 is parallel to the center axis, and the end 1110 of the first outer circumferential surface 111 extends such that an upper portion of the end 1110 in the axial direction inclines rearward in the rotating direction relative to a lower portion thereof. In such a configuration, the inclined surface 132 of the connecting portion 13*a* is given as a surface not inclining relative to the axial direction.

In the case of the impeller A1, since the inclined surface 132 is not inclined relative to the axial direction, the connecting portion 13*a* can be molded using the mold that is to be drawn downward in the axial direction. Thus, in the impeller A1, the entirety of the second outer circumferential surface 112 can be molded using the mold that is to be drawn downward in the axial direction. As illustrated in FIG. 8, regarding the second outer circumferential surface 112, a distance from the center axis to its lower portion in the axial direction may be smaller than that from the center axis to its upper portion in the axial direction. In other words, a tangential plane at an arbitrary point on the second outer circumferential surface 112 is parallel to the center axis, or it is positioned closer to the center axis on the lower side in the axial direction than on the upper side. Thus, a distance from the center axis to the upper portion of the second outer circumferential surface 112 in the axial direction is longer than that from the center axis to the lower portion thereof. When the second outer circumferential surface 112 and the connecting portion 13*a* have the above-described shapes, they can be molded using the mold that is to be drawn downward in the axial direction. It is to be noted that, since the inclined surface 132 of the connecting portion 13*a* in this modification is not inclined relative to the center axis, the connecting portion 13*a* may be molded using the mold that is to be drawn upward in the axial direction.

Figure 9:
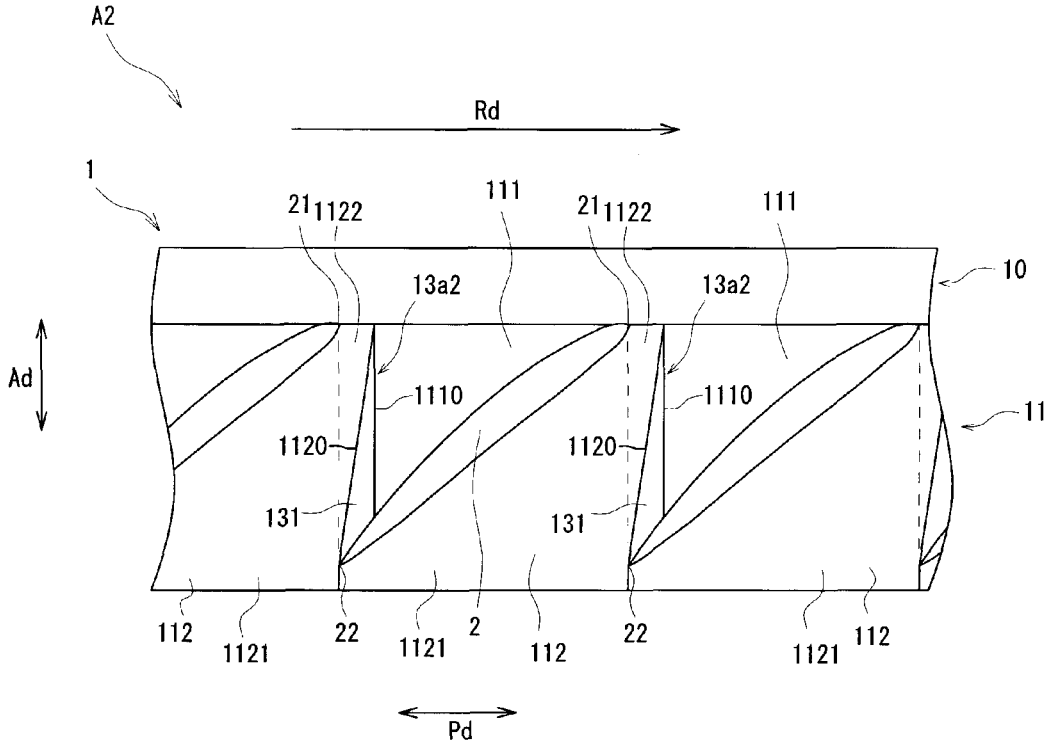
FIG. 9 is a development view of another modification of the impeller according to the first embodiment.

Another modification of the hub 1 in the first embodiment will be described below with reference to the drawing. FIG. 9 is a development view of another modification of the impeller according to the first embodiment. An impeller A2 according to this modification has the same structure as the impeller A except for a position of a connecting portion 13*a*2. Accordingly, substantially the same components are denoted by the same reference signs, and detailed description of those components is omitted.

As represented by the impeller A2 illustrated in FIG. 9, no gap area is formed in some cases between the inclined blades 2 adjacent to each other in the circumferential direction. In such a case, the connecting portion 13*a*2 is disposed above a portion of the inclined blade 2 in the axial direction, the portion being vertically overlapped with the first outer circumferential surface 111 in the axial direction. In other words, the end 1110 of the first outer circumferential surface 111 on the rear side in the rotating direction and the end 1120 of the second outer circumferential surface 112 on the front side in the rotating direction are overlapped with the inclined blade 2 in the axial direction above the inclined blade 2.

By forming the connecting portion 13*a*2 in the above-described shape, the first outer circumferential surface 111 can be formed in such a shape that its curvature radius gradually increases in the axial direction toward the lower side from the upper side. Furthermore, the first outer circumferential surface 111, the connecting portion 13*a*2, and the second portion 1122 of the second outer circumferential surface 112 can be molded using a mold that is to be drawn upward in the axial direction. The first portion 1121 of the second outer circumferential surface 112 can be molded using a mold that is to be drawn downward in the axial direction. Thus, the impeller A2 can be molded using the mold that is to be drawn upward in the axial direction and the mold that is to be drawn downward in the axial direction, even when the gap area is not formed in the circumferential direction of the hub 1 between the rear edge 22 of the inclined blade 2, which is arranged on the front side in the rotating direction, and the front edge 21 of the inclined blade 2, which is arranged on the rear side in the rotating direction.

As illustrated in FIGS. 5 and 6, the airflow Afw flows over the outer circumferential surface 11 of the hub 1 in the direction opposite to the rotating direction Rd with respect to the outer circumferential surface 11. The first embodiment discloses the connecting portion 13 having the inclined surface 131 that connects the first outer circumferential surface 111 and the second outer circumferential surface 112 to each other with a flat surface interposed therebetween. When the flow velocity of the airflow Afw in the circumferential direction with respect to the outer circumferential surface 11 is slow, for example, the airflow Afw flows along the outer circumferential surface 11, namely along the first outer circumferential surface 111, the inclined surface 131, and the second outer circumferential surface 112.

At a joining boundary between the first outer circumferential surface 111 and the inclined surface 131, a surface angle changes abruptly. When the flow velocity of the airflow Afw in the circumferential direction with respect to the outer circumferential surface 11 is fast, the airflow Afw is given with inertial force in a tangential direction of the first outer circumferential surface 111. Therefore, the airflow Afw tends to flow in the tangential direction of the first outer circumferential surface 111. In other words, the airflow Afw tends to flow in the tangential direction at the end 111 of the first outer circumferential surface 111; namely it tends to flow apart from the inclined surface 131. Here, flowing of the airflow Afw apart from the outer circumferential surface 11 is called departing of the airflow Afw. The departing of the airflow Afw generates vortexes, etc. and disturbs the airflow Afw. With disturbance of the airflow, vibration of the impeller is caused and noise is generated.

Figure 10:
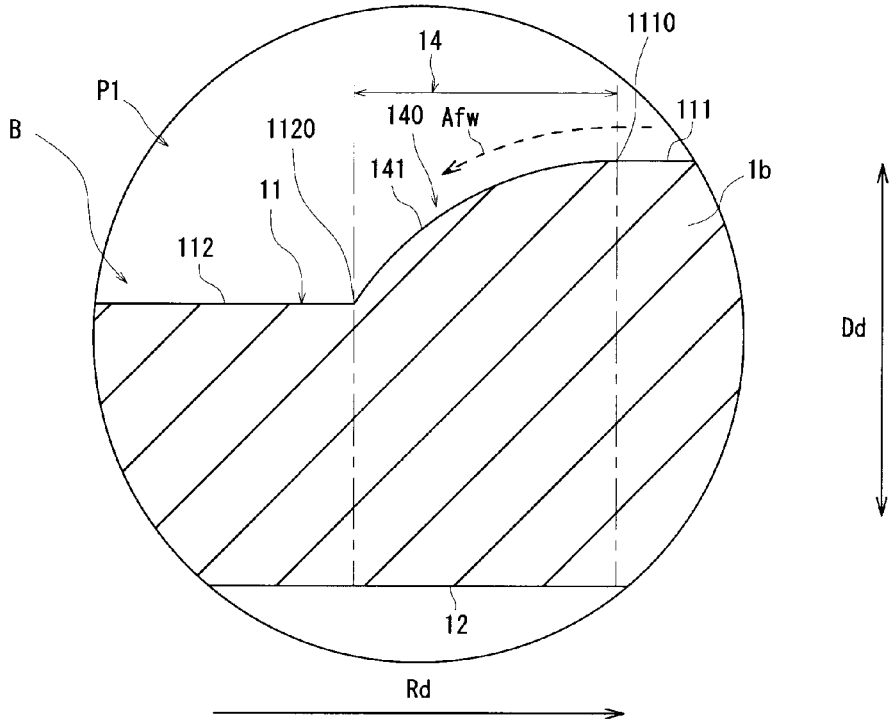
FIG. 10 is a sectional view illustrating, in an enlarged scale, another example of the connecting portion of the impeller according to the present invention.

In consideration of the above point, an impeller B according to an exemplary second embodiment of the present invention, illustrated in FIG. 10, includes a connecting portion 14 capable of suppressing the departing of the airflow Afw at the end of the first outer circumferential surface 111 on the rear side in the rotating direction. FIG. 10 is a sectional view illustrating, in an enlarged scale, another example of the connecting portion of the impeller according to the present invention. The sectional view of FIG. 10 represents the same region of the hub as that surrounded by a circle in the sectional view of FIG. 5. Thus, in FIG. 10, that region of the hub is illustrated in the inside of a circle P1. A hub 1*b* in the second embodiment, illustrated in FIG. 10, includes the connecting portion 14. The other portions have the same configurations as those of the hub 1 in the first embodiment. Accordingly, substantially the same portions are denoted by the same reference signs, and detailed description of those portions is omitted.

As illustrated in FIG. 10, the connecting portion 14 has an inclined surface 140. The inclined surface 140 includes a first inclined portion 141. The first outer circumferential surface 111 is in continuity, at the end 1110 thereof on the rear side in the rotating direction, with the first inclined portion 141 in a differentiable fashion. In other words, the end 1110 of the first outer circumferential surface 111 and the first inclined portion 141 are joined to each other in a smooth form. The first inclined portion 141 has a convex shape relative to the outer circumferential surface 11. The "convex shape relative to the outer circumference surface" implies a shape that a projected region of a curved surface faces outward in the radial direction. In the case of the curved surface having a circular-arc cross-section, the "convex shape relative to the outer circumference surface" implies a shape that the center of a curvature of the circular-arc cross-section is positioned closer to the center axis with respect to the outer circumferential surface 11. Hence the inclined surface 140 includes the first inclined portion 141 having the convex shape relative to the outer circumferential surface 11.

Thus, the first outer circumferential surface 111 and the inclined surface 140 are in continuity with each other at the end 1110 of the first outer circumferential surface 111 in a differentiable fashion. In other words, tangential lines to the inclined surface 140 and the first outer circumferential surface 111 in the circumferential direction are aligned with each other at the end 1110 of the first outer circumferential surface 111. Therefore, when the airflow Afw flowing along the first outer circumferential surface 111 enters over the first inclined portion 141, a flow direction hardly changes. Thus, the airflow Afw flowing along the first outer circumferential surface 111 is less apt to depart away from the first outer circumferential surface 111 at the time of entering over the first inclined portion 141. Furthermore, since the first inclined portion 141 has the convex shape relative to the outer circumference surface 11, an inclination angle of the first inclined portion 141 changes slowly. As a result, the airflow Afw is less apt to depart away from the first inclined portion 141 and flows along the inclined surface 140.

With the impeller B including the connecting portion 14, it is possible to suppress vibration, noise, etc. of the impeller B during operation. The first inclined portion 141 may be a circumferential surface having a uniform curvature along the axial direction, or a curved surface of which curvature is changed along the axial direction. Moreover, the first inclined portion 141 may have a shape defined by a curved surface having a cross-section that is not a circular-arc, the shape being obtained, for example, by combining a plurality of curved surfaces with different curvatures in the circumferential direction. Alternatively, the first inclined portion 141 may have a shape having a cross-section that is defined by a curved line in terms of a quadratic function, a trigonometric function, etc. A variety of convex shapes capable of being formed in continuity with the first outer circumferential surface 111 in a differentiable fashion can be optionally employed as the first inclined portion 141.

Other features are the same as those in the first embodiment.

Figure 11:
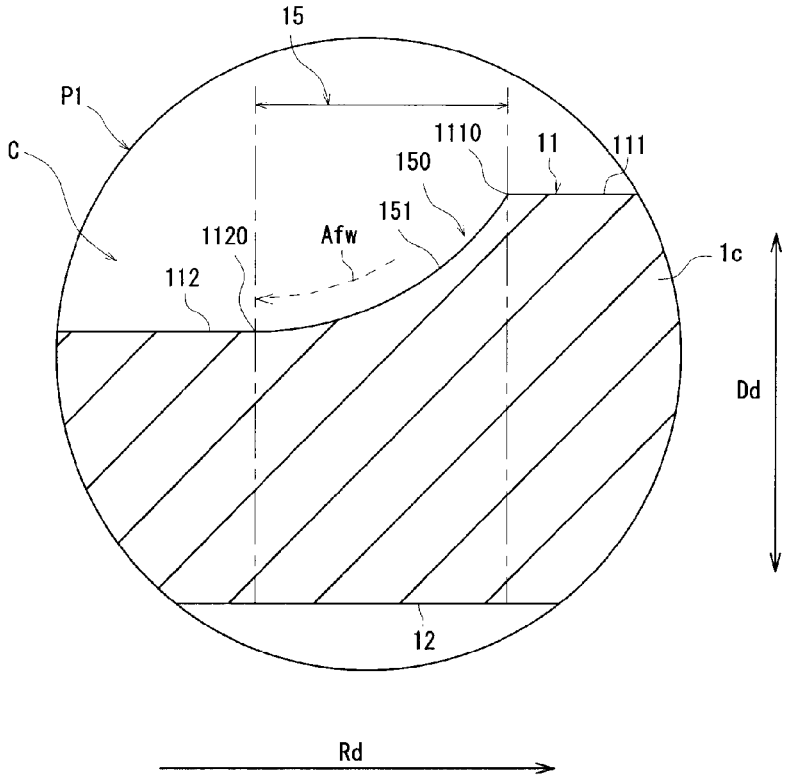
FIG. 11 is a sectional view illustrating, in an enlarged scale, still another example of the connecting portion of the impeller according to the present invention.

An impeller C according to an exemplary third embodiment of the present invention will be described below with reference to the drawing. FIG. 11 is a sectional view illustrating, in an enlarged scale, still another example of the connecting portion of the impeller according to the present invention. The sectional view of FIG. 11 represents the same region of the hub as that surrounded by the circle in the sectional view of FIG. 5. Thus, in FIG. 11, that region of the hub is illustrated in the inside of a circle P1. As illustrated in FIG. 11, a hub 1*c* in the third embodiment includes a connecting portion 15. The other portions have the same configurations as those of the hub 1 in the first embodiment. Accordingly, substantially the same portions are denoted by the same reference signs, and detailed description of those portions is omitted.

In the hub 1 according to the first embodiment, the inclined surface 131 contacts the second outer circumferential surface 112 at an angle formed between both the surfaces. Therefore, the airflow Afw after flowing over the inclined surface 131 impacts against the second outer circumferential surface 112 at the end 1120 of the second outer circumferential surface 112. When pressure of the airflow Afw is large, for example, large force is generated upon the impact of the airflow against the second outer circumferential surface 112. Such force may cause vibration, of the impeller A, noise, etc. in some cases.

In the impeller C according to the third embodiment, as illustrated in FIG. 11, the hub 1*c* includes the connecting portion 15. The inclined surface 150 of the connecting portion 15 includes a second inclined portion 151. In the outer circumferential surface 11, the second inclined portion 151 and the second outer circumferential surface 112 are in continuity with each other at the end 1120 of the second outer circumferential surface 112 in a differentiable fashion. In other words, the end 1120 of the second outer circumferential surface 112 and the second inclined portion 151 are joined to each other in a smooth form. The second inclined portion 151 has a concave shape relative to the outer circumferential surface 11. The "concave shape relative to the outer circumference surface 11" implies a shape recessed inward in the radial direction. Assuming that a curved surface of the second inclined portion 151 has a circular-arc cross-section, the "concave shape relative to the outer circumference surface 11" implies a shape that the center of a curvature of the circular-arc cross-section is positioned on the side opposite to the center axis with respect to the outer circumferential surface 11. Accordingly, the inclined surface 150 includes the second inclined portion 151 having the concave shape relative to the outer circumferential surface 11.

Thus, the inclined surface 150 and the second outer circumferential surface 112 are in continuity with each other at the end 1120 of the second outer circumferential surface 112 in a differentiable fashion. In other words, tangential lines to the inclined surface 150 and the second outer circumferential surface 112 in the circumferential direction are aligned with each other at the end 1120 of the second outer circumferential surface 112. A flow angle of the airflow Afw flowing along the inclined surface 150 gradually changes along the second inclined portion 151. A flow direction of the airflow Afw is a tangential direction of the second inclined portion 151. Respective tangential directions of the second inclined portion 151 and the second outer circumferential surface 112 are the same at the end 1120 of the second outer circumferential surface 112. Therefore, the airflow Afw flowing along the second inclined portion 151 is caused to flow along the second outer circumferential surface 112 without impacting against the second outer circumferential surface 112.

Accordingly, the airflow Afw entering over the second outer circumferential surface 112 can be suppressed from impacting against the second outer circumferential surface 112. Hence vibration, noise, etc. can be suppressed during operation of the impeller C. The second inclined portion 151 may be a circumferential surface having a uniform curvature along the axial direction, or a curved surface of which curvature is changed along the axial direction. Moreover, the second inclined portion 151 may have a shape defined by a curved surface having a cross-section that is not a circular-arc, the shape being obtained, for example, by combining a plurality of curved surfaces with different curvatures together in the circumferential direction. Alternatively, the second inclined portion 151 may have a shape having a cross-section that is defined by a curved line in terms of a quadratic function, a trigonometric function, etc. A variety of concave shapes capable of being formed in continuity with the second outer circumferential surface 112 in a differentiable fashion can be optionally employed as the second inclined portion 151.

Other features are the same as those in the first embodiment.

Figure 12:
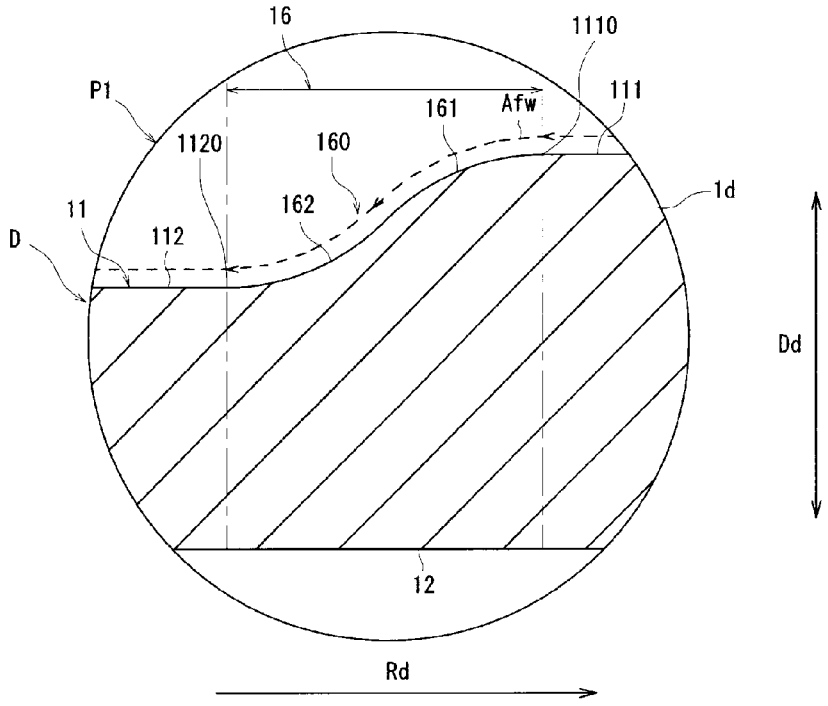
FIG. 12 is a sectional view illustrating, in an enlarged scale, still another example of the connecting portion of the impeller according to the present invention.

An impeller D according to an exemplary fourth embodiment of the present invention will be described below with reference to the drawing. FIG. 12 is a sectional view illustrating, in an enlarged scale, still another example of the connecting portion of the impeller according to the present invention. The sectional view of FIG. 12 represents the same region of the hub as that surrounded by the circle in the sectional view of FIG. 5. Thus, in FIG. 12, that region of the hub is illustrated in the inside of a circle P1. As illustrated in FIG. 12, the impeller D according to the fourth embodiment includes a connecting portion 16. The other portions have the same configurations as those of the hub 1 in the first embodiment. Accordingly, substantially the same portions are denoted by the same reference signs, and detailed description of those portions is omitted.

As illustrated in FIG. 12, the connecting portion 16 has an inclined surface 160. The inclined surface 160 includes a first inclined portion 161 and a second inclined portion 162. The first inclined portion 161 has a convex shape relative to the outer circumferential surface 11 similarly to the first inclined portion 141 of the inclined surface 140 described in the second embodiment. The first outer circumferential surface 111 and the first inclined portion 161 are in continuity with each other at the end 1110 of the first outer circumferential surface 111 in a differentiable fashion. In other words, the first outer circumferential surface 111 and the first inclined portion 161 are joined to each other in the form of a smooth curved surface.

The second inclined portion 162 has a concave shape relative to the outer circumferential surface 11 similarly to the second inclined portion 151 of the inclined surface 150 described in the third embodiment. The second inclined portion 162 and the second outer circumferential surface 112 are in continuity with each other at the end 1120 of the second outer circumferential surface 112 in a differentiable fashion. In other words, the second inclined portion 162 and the second outer circumferential surface 112 are joined to each other in the form of a smooth curved surface.

The first inclined portion 161 is arranged on the front side in the rotating direction, and the second inclined portion 162 is arranged on the rear side in the rotating direction. The first inclined portion 161 and the second inclined portion 162 are joined to each other in the circumferential direction. At a joining boundary between the first inclined portion 161 and the second inclined portion 162, the first inclined portion 161 and the second inclined portion 162 are joined to each other in a differentiable fashion. In other words, the first inclined portion 161 and the second inclined portion 162 are jointed to each other in a smooth form.

Thus, the inclined surface 160 includes the first inclined portion 161 that is in continuity with the first outer circumferential surface 111 and that has a convex shape relative to the outer circumferential surface 11, and the second inclined portion 162 that is in continuity with both the first inclined portion 161 and the second outer circumferential surface 112 and that has a convex shape relative to the outer circumferential surface 11.

In the connecting portion 16, with the presence of the first inclined portion 161, the airflow Afw can be suppressed from departing away from the end of the first outer circumferential surface 111 on the rear side in the rotating direction. Furthermore, with the presence of the second inclined portion 162, the airflow Afw can be suppressed from impacting against the front side of the second outer circumferential surface 112 in the rotating direction. As a result, using the impeller D makes it possible to suppress vibration, noise, etc., which are generated due to the departing of the airflow Afw from the outer circumferential surface 11 and the impact of the airflow Afw against the outer circumferential surface 11.

Other features are the same as those in the first embodiment.

Figure 13:
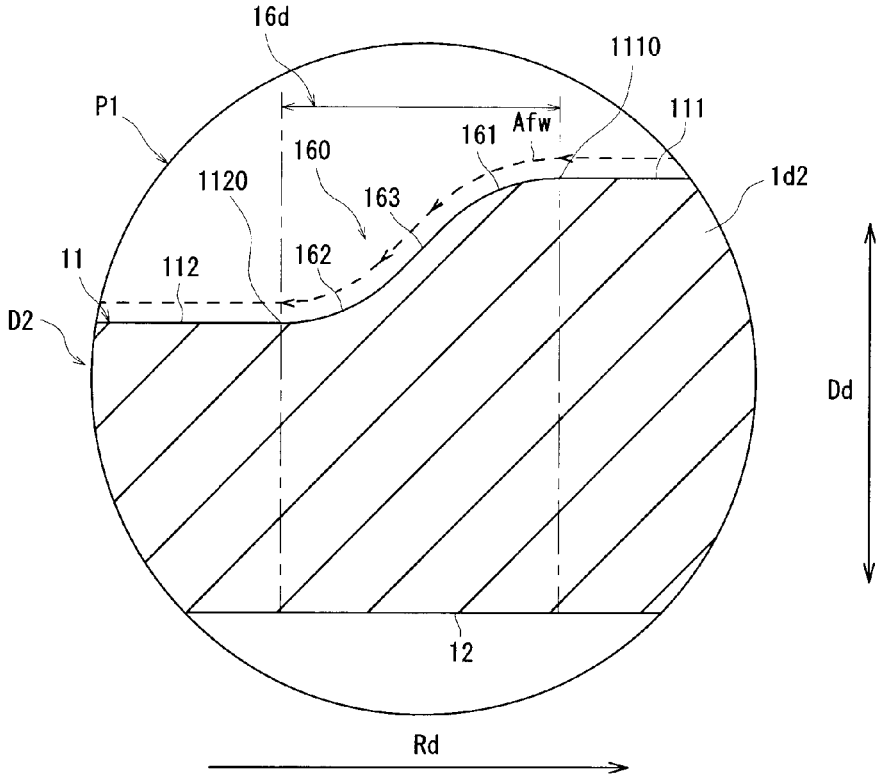
FIG. 13 is a sectional view illustrating, in an enlarged scale, still another example of the connecting portion of the impeller according to the present invention.

A modification of the impeller according to the exemplary fourth embodiment of the present invention will be described below with reference to the drawing. FIG. 13 is a sectional view illustrating, in an enlarged scale, still another example of the connecting portion of the impeller according to the present invention. The sectional view of FIG. 13 represents the same region of the hub as that surrounded by the circle in the sectional view of FIG. 5. Thus, in FIG. 13, that region of the hub is illustrated in the inside of a circle P1.

In an impeller D2 illustrated in FIG. 13, a hub 1*d*2 includes the connecting portion 16*d*. The connecting portion 16*d* includes a third inclined portion 163 in the form of a flat surface between a first inclined portion 161 and a second inclined portion 162. The third inclined portion 163 is joined to an end of the first inclined portion 161 on the rear side in the rotating direction and to an end of the second inclined portion 162 on the front side in the rotating direction. The first inclined portion 161 and the third inclined portion 163 are in continuity with each other at a joining boundary between the first inclined portion 161 and the third inclined portion 163 in a differentiable fashion. In other words, the first inclined portion 161 and the third inclined portion 163 are joined to each other in a smooth form. Moreover, the second inclined portion 162 and the third inclined portion 163 are in continuity with each other at a joining boundary between the second inclined portion 162 and the third inclined portion 163 in a differentiable fashion. In other words, the second inclined portion 162 and the third inclined portion 163 are joined to each other in a smooth form.

Thus, the first inclined portion 161 and the second inclined portion 162 may be joined to each other with interposition of the third inclined portion 163 in the form of a flat surface therebetween. The third inclined portion 163 is not limited to a flat surface, and it may be a curved surface. When the third inclined portion 163 is a curved surface, the curved surface may be optionally convex or concave. Alternatively, the curved surface may have a shape in combination of both convex and concave surfaces. When the third inclined portion 163 is formed as a curved surface, the third inclined portion 163 preferably has a larger curvature radius than those of the first inclined portion 161 and the second inclined portion 162 in order to suppress disturbance of the airflow Afw.

In the above-described impellers D and D2 according to the fourth embodiment, the departing and the impact of the airflow can be suppressed even when the impellers are rotated reversely and the airflow are caused to flow over the outer circumferential surface 11 in a direction opposite to the direction of the airflow Afw. With the impellers D and D2, therefore, vibration, noise, etc. can be suppressed even when an air blowing direction is changed over. It is to be noted that, in the impellers according to the first to third embodiments as well, the departing and the impact of the airflow can be suppressed depending on conditions, such as flow velocity and pressure, even when the impellers are rotated reversely.

Figure 14:
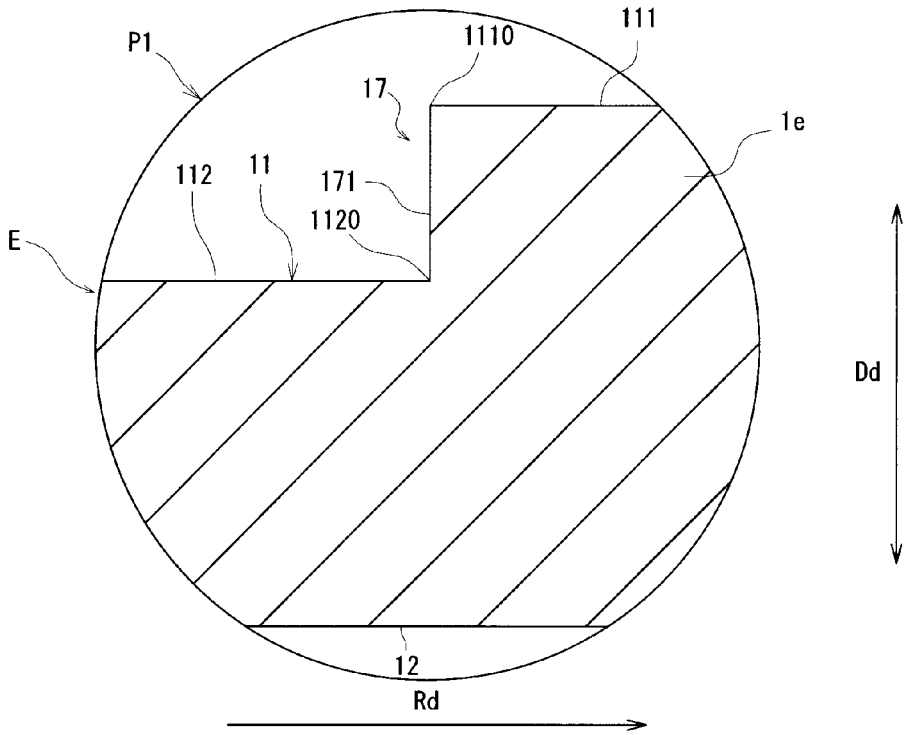
FIG. 14 is a sectional view illustrating, in an enlarged scale, still another example of the connecting portion of the impeller according to the present invention.

An impeller E according to an exemplary fifth embodiment of the present invention will be described below with reference to the drawing. FIG. 14 is a sectional view illustrating, in an enlarged scale, still another example of the connecting portion of the impeller according to the present invention. The sectional view of FIG. 14 represents the same region of the hub as that surrounded by the circle in the sectional view of FIG. 5. Thus, in FIG. 14, that region of the hub is illustrated in the inside of a circle P1. As illustrated in FIG. 14, the impeller E according to the fifth embodiment includes a hub 1*e* including a connecting portion 17. The other portions have the same configurations as those of the hub 1 in the first embodiment. Accordingly, substantially the same portions are denoted by the same reference signs, and detailed description of those portions is omitted.

As illustrated in FIG. 14, the hub 1*e* includes a joining region 171 that is joined to the end of the first outer circumferential surface 111 on the rear side in the rotating direction and to the end of the second outer circumferential surface 112 on the front side in the rotating direction. The joining region 171 and the end 1110 of the first outer circumferential surface 111 on the rear side in the rotating direction extend perpendicularly to a tangential direction at the end 1110 in the circumferential direction. Moreover, the joining region 171 and the end 1120 of the second outer circumferential surface 112 on the front side in the rotating direction extend perpendicularly to a tangential direction at the end 1120 in the circumferential direction.

In other words, the connecting portion 17 includes the joining region 171 in the form of a flat surface, which joins the first outer circumferential surface 111 and the second outer circumferential surface 112 to each other. The joining region 171 is perpendicular to the tangential direction of the first outer circumferential surface 111 at the end 1110 of the first outer circumferential surface 111. In addition, the joining region 171 is perpendicular to the tangential direction of the second circumferential surface 112 at the end 1120 of the second outer circumferential surface 112.

The joining region 171 has a surface that is not inclined in the circumferential direction. Because of including the joining region 171, the connecting portion 17 is not inclined in the axial direction as well. In an injection molding step, therefore, the connecting portion 17 can also be molded using the mold that is to be drawn downward in the axial direction. In other words, a width in the circumferential direction is not needed to form the inclined surface.

Since the inclined surface does not need a width in the circumferential direction, the rear edge 22 of the inclined blade 2 on the front side in the rotating direction and the front edge of the inclined blade 2 on the rear side in the rotating direction can be positioned closer to each other in the circumferential direction. As a result, the airflow can be generated efficiently.

Other features are the same as those in the first embodiment.

Figure 15:
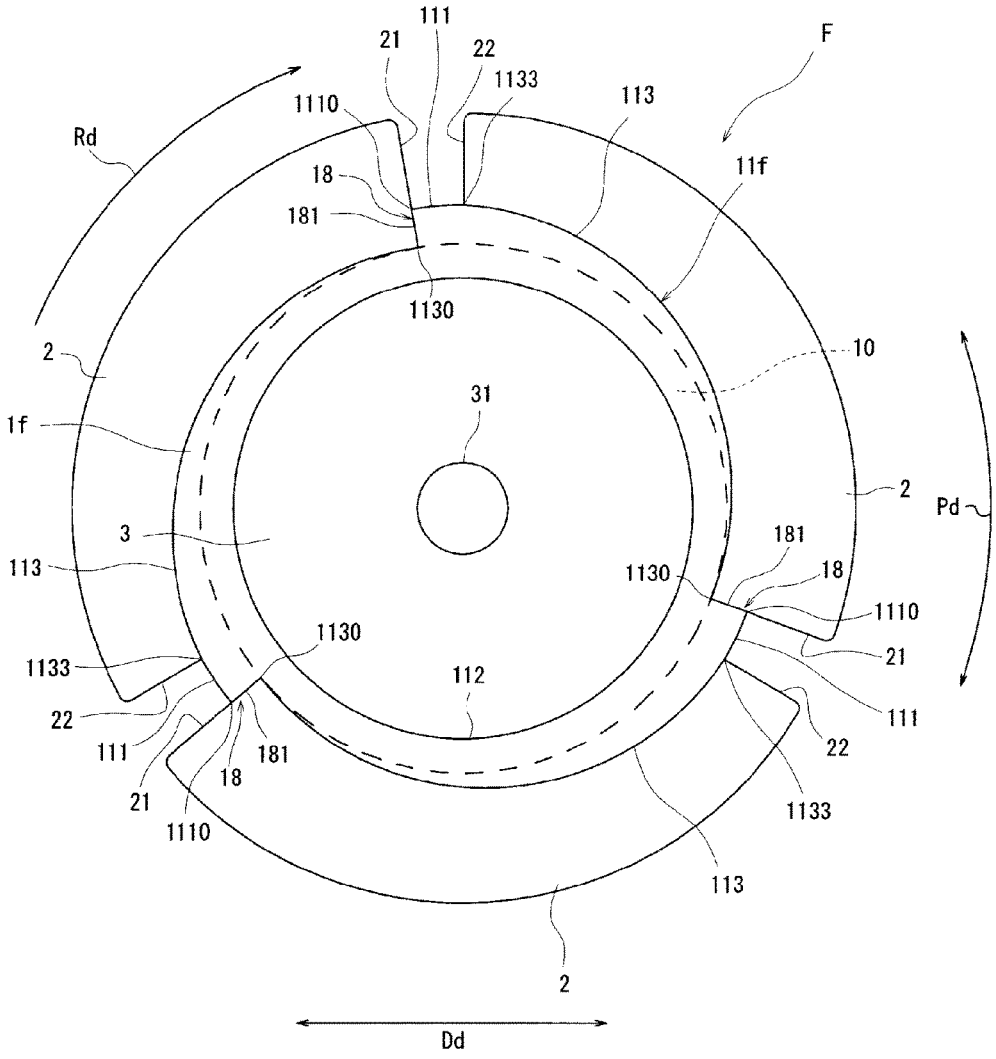
FIG. 15 is a bottom view when looking at still another example of the impeller according to the present invention from the lower side in the axial direction.

An impeller F according to an exemplary sixth embodiment of the present invention will be described below with reference to the drawing. FIG. 15 is a bottom view when looking at still another example of the impeller according to the present invention from the lower side in the axial direction. The impeller F illustrated in FIG. 15 has the same structure as that of the impeller D according to the fifth embodiment except for a second outer circumferential surface 113 of an outer circumferential surface 11*f* of the hub 1*f*. Accordingly, substantially the same components are denoted by the same reference signs, and detailed description of those components is omitted.

As illustrated in FIG. 15, the second outer circumferential surface 113 of the impeller F is a curved surface shaped such that a distance from the center axis to the second outer circumferential surface 113 gradually increases from an end 1130 of the second outer circumferential surface 113 on the front side in the rotating direction toward the rear side in the rotating direction. Furthermore, the second outer circumferential surface 113 is continuously joined, at its end 1133 on the rear side in the rotating direction, to the first outer circumferential surface 111 in a smooth form, for example, in a differentiable fashion. In addition, the second outer circumferential surface 113 is a curved surface that is arranged at a position overlapping the inclined blade 2 in the axial direction, and that has a tangential plane parallel to the center axis at an arbitrary point.

A connecting portion 18 of the impeller F has a joining surface 181 in the form of a flat surface, which is joined to the first outer circumferential surface 111 and the second outer circumferential surface 113. The joining surface 181 is perpendicular to the tangential direction of the first outer circumferential surface 111 at the end 1110 of the first outer circumferential surface 111. Moreover, the joining region 181 is perpendicular to the tangential direction of the second outer circumferential surface 113 at the end 1130 of the second outer circumferential surface 113.

Thus, since the connecting portion 18 does not need a width in the circumferential direction to define an inclined surface, the rear edge 22 of the inclined blade 2 on the front side in the rotating direction and the front edge 21 of the inclined blade 2 on the rear side in the rotating direction can be positioned closer to each other in the circumferential direction. As a result, the airflow can be generated efficiently.

The hub 1*f* is configured so as to smoothly join the end 1133 of the second outer circumferential surface 113 on the rear side in the rotating direction to the first outer circumferential surface 111. More specifically, in the hub 1*f*, the second outer circumferential surface 113 is a curved surface shaped such that the distance from the center axis to the second outer circumferential surface 113 gradually increases from the front side in the rotating direction toward the rear side in the rotating direction. In addition, at a boundary where the end 1133 of the second outer circumferential surface 113 on the rear side in the rotating direction is joined to the first outer circumferential surface 111, the end 1133 of the second outer circumferential surface 113 on the rear side and the first outer circumferential surface 111 are joined to each other in a differentiable fashion.

Thus, in the configuration that the outer circumferential surface 11*f* extends beyond the rear edge 22 of the inclined blade 2 in the axial direction, the airflow is less susceptible to disturbance in a region where the airflow enters over the first outer circumferential surface 111 of the outer circumferential surface 11*f* from the end 1133 of the second outer circumferential surface 113 thereof on the rear side. It is hence possible to suppress vibration, noise, etc., which are generated due to the disturbance of the airflow.

Other features are the same as those in the first embodiment.

Figure 16:
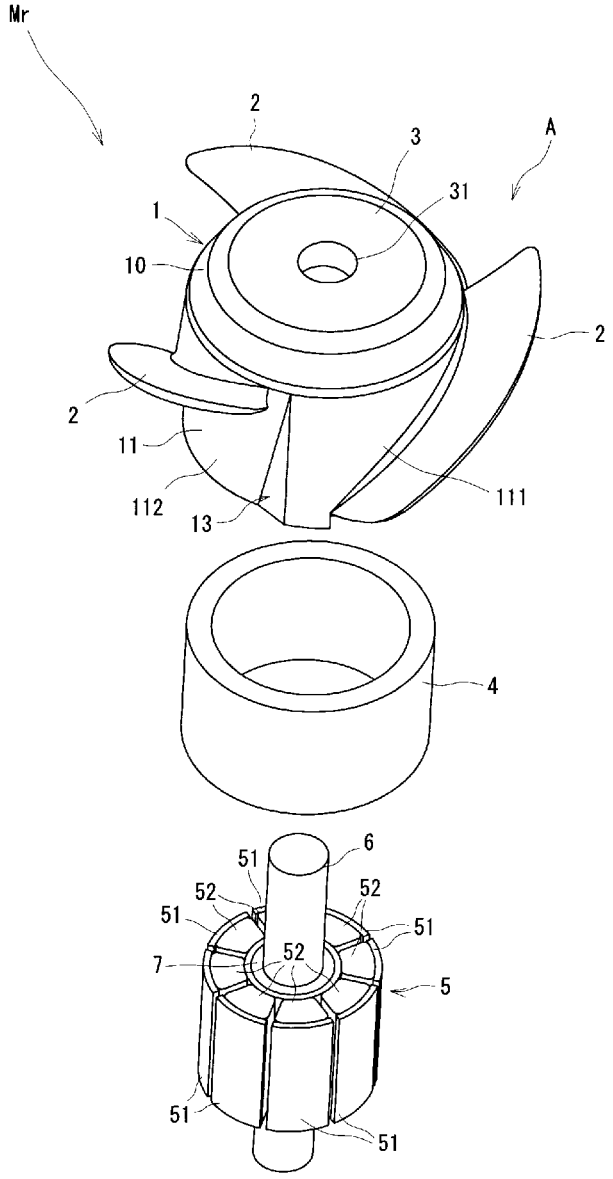
FIG. 16 is an exploded perspective view when a motor including the impeller according to the present invention is disassembled in the axial direction.

An exemplary motor according to the present invention will be described below with reference to the drawing. FIG. 16 is an exploded perspective view when the motor including the impeller according to the present invention is disassembled in the axial direction. While the impeller A described in the first embodiment is mounted to a motor Mr illustrated in FIG. 16, the present invention is not limited to such a case. The impellers described in the above second to sixth embodiments may be optionally mounted depending on the intended use, flow velocity, temperature, etc.

As illustrated in FIG. 16, the motor Mr according to this embodiment includes the impeller A, a magnet 4, a stator 5, a shaft 6, and a bearing 7. The impeller A has the same structure as that described above and, therefore, detailed description of the impeller A is omitted.

The magnet 4 has a cylindrical shape extending in the axial direction. The magnet 4 includes a plurality of magnet poles that are alternately arrayed in the circumferential direction. An outer circumferential surface of the magnet 4 is fixed to the inner circumference surface 12 of the impeller A. The outer circumferential surface of the magnet 4 and the inner circumference surface 12 of the impeller A are fixedly bonded using an adhesive. However, a fixing method is not limited to bonding, and both the surfaces may be fixed to each other by press fitting, light press fitting, welding, screwing, etc. Thus, a variety of methods capable of fixing the magnet 4 to be immobile relative the impeller A may be used optionally.

The stator 5 is formed by stacking a plurality of magnetic steel plates in the axial direction. The stator 5 includes a plurality of teeth 51 that are arranged side by side in the circumferential direction, and coils 52 wound around the teeth 51. Electric power is supplied to the coils 52 from a circuit not illustrated.

The shaft 6 is a rotary shaft. The shaft 6 is rotatably supported to the stator 5 with the aid of the bearing 7. The bearing 7 is constituted as a rolling bearing using balls, cylindrical rods, etc., but examples of the bearing 7 are not limited to the above-described ones. A slide bearing may also be used as another example. The bearing 7 is arranged at each of an upper end, illustrated in the drawing, of the stator 5 in the axial direction and a not-illustrated lower end of the stator 5 in the axial direction. Thus, the shaft 6 is supported to the upper and lower ends of the stator 5 in the axial direction with the aid of the bearings 7.

The shaft 6 is fixed to an inner surface of the boss hole 31 of the impeller A. The shaft 6 is fixed in the boss hole 31 by press fitting. Thus, relative movement between the shaft 6 and the impeller A is suppressed. A method of fixing the shaft 6 in the boss hole 31 is not limited to the press fitting. A variety of fixing methods capable of suppressing the relative movement between the shaft 6 and the impeller A, such as bonding, welding, and screwing, may be used optionally. The impeller A, the magnet 4, and the shaft 6 serve as a rotor of the motor Mr. In other words, the motor Mr includes the rotor and the stator 5. The impeller A is fixed to the rotor.

When a current is supplied to flow through the coils 52, the rotor is rotated by the action of magnetic forces that are generated between the coils 52 and the magnetic poles of the magnet 4. As described in this embodiment, the impeller A can constitute part of the rotor of the motor Mr. In this embodiment, the motor Mr is a motor of the type that the magnet 4 constituting the rotor is arranged on the outer side of the stator 5 in the radial direction, i.e., an outer rotor motor. However, the motor Mr is not limited to the above-mentioned type. The motor Mr may be an inner rotor motor in which the magnet constituting the rotor is arranged on the inner side of the stator in the radial direction.

Although the embodiments of the present invention have been described above, the embodiments can be modified in various ways as far as falling within the scope not departing from the gist of the present invention.

The present invention can be applied to impellers that are used to supply flows of air for the purpose of cooling the interiors of, for example, home electrical appliances such as a refrigerator, and rooms where many electronic devices are installed, such as a server room.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An impeller comprising:

a hub having an outer circumferential surface, the hub being rotated about a center axis extending in an up-down direction; and a plurality of inclined blades that are disposed on the outer circumferential surface of the hub at intervals in a circumferential direction, the inclined blades being inclined relative to the center axis and arranged such that a front edge of each of the inclined blades in a rotating direction is positioned on an upper side than a rear edge thereof, the outer circumferential surface of the hub including:

a first outer circumferential surface including a portion arranged at a position overlapping the inclined blade in a direction of the center axis, the position being present above a joined portion of the outer circumferential surface to the inclined blade;

a second outer circumferential surface including a portion arranged at a position overlapping the inclined blade in the direction of the center axis, the position being present rearward of the first outer circumferential surface in the rotating direction and below the joined portion of the outer circumferential surface to the inclined blade; and a connecting portion that connects an end of the first outer circumferential surface on a rear side in the rotating direction and an end of the second outer circumferential surface on a front side in the rotating direction to each other, wherein the connecting portion is arranged forward of the front edge of the inclined blade in the rotating direction, the first outer circumferential surface is a curved surface having a curvature radius that gradually increases downward from above, a tangential plane at an arbitrary point on the second outer circumferential surface is positioned parallel to the center axis or farther away from the center axis on an upper side than on a lower side, and a distance from the center axis to an arbitrary first point, which is positioned at the end of the first outer circumferential surface on the rear side in the rotating direction, is equal to or longer than a distance from the center axis to a second point, which is positioned at the end of the second outer circumferential surface on the front side in the rotating direction and at a same position as the first point in the direction of the center axis.

2. The impeller according to claim 1, wherein the connecting portion is positioned between the rear edge of the inclined blade on the front side in the rotating direction of the hub and the front edge of the inclined blade on the rear side in the rotating direction of the hub.

3. The impeller according to claim 1, wherein the connecting portion includes an inclined surface having a distance from the center axis in a radial direction, the distance gradually decreasing from a first outer circumferential surface side toward a second outer circumferential surface side.

4. The impeller according to claim 3, wherein the inclined surface includes a first inclined portion having a convex shape relative to the outer circumferential surface.

5. The impeller according to claim 3, wherein the inclined surface includes a second inclined portion having a concave shape relative to the outer circumferential surface.

6. The impeller according to claim 3, wherein the inclined surface includes:

a first inclined portion that is in continuity with the first outer circumferential surface, and that has a convex shape relative to the outer circumferential surface; and a second inclined portion that is in continuity with each of the first inclined portion and the second outer circumferential surface, and that has a concave shape relative to the outer circumferential surface.

7. The impeller according to claim 3, wherein the inclined surface includes:

a first inclined portion that is in continuity with the first outer circumferential surface, and that has a convex shape relative to the outer circumferential surface;

a second inclined portion that is in continuity with the second outer circumferential surface, and that has a concave shape relative to the outer circumferential surface; and a third inclined portion that is in form of a flat surface, and that is arranged between the first inclined portion and the second inclined portion to be in continuity with the first inclined portion and the second inclined surface, respectively.

8. The impeller according to claim 1, wherein the connecting portion has a joining surface that is perpendicular to a tangential direction of the first outer circumferential surface at an end joining to the first outer circumferential surface, and that is perpendicular to a tangential direction of the second outer circumferential surface at an end joining to the second outer circumferential surface.

9. The impeller according to claim 1, wherein the second outer circumferential surface is a surface having a distance from the center axis, the distance gradually increasing from the front side in the rotating direction toward the rear side in the rotating direction.

10. A motor comprising:

a stator;

a rotor supported rotatably relative to the stator; and the impeller according to claim 1, the impeller being fixed to the rotor.

* * * * *